US009664408B2

(12) United States Patent
Monzon et al.

(10) Patent No.: US 9,664,408 B2
(45) Date of Patent: May 30, 2017

(54) VENT COVER

(71) Applicants: Abel Monzon, Las Vegas, NV (US); Abel Monzon, Chula Vista, CA (US)

(72) Inventors: Abel Monzon, Las Vegas, NV (US); Abel Monzon, Chula Vista, CA (US)

( * ) Notice: Subject to any disclaimer, the term of this patent is extended or adjusted under 35 U.S.C. 154(b) by 435 days.

(21) Appl. No.: 14/208,946

(22) Filed: Mar. 13, 2014

(65) Prior Publication Data

US 2014/0273809 A1 Sep. 18, 2014

Related U.S. Application Data

(60) Provisional application No. 61/802,092, filed on Mar. 15, 2013.

(51) Int. Cl.
*F24F 13/20* (2006.01)
*F24F 13/08* (2006.01)

(52) U.S. Cl.
CPC ..... *F24F 13/082* (2013.01)

(58) Field of Classification Search
CPC ..... F24F 13/082; F24F 13/20; F24F 2221/52; F24F 13/06; F24F 2221/14; F24F 7/10
USPC .... 454/71, 73, 274, 298, 367, 292, 310, 300
See application file for complete search history.

(56) References Cited

U.S. PATENT DOCUMENTS 2,616,355 A * 11/1952 McCabe ..... F24F 13/062 454/312
2,772,624 A * 12/1956 Carnes ..... F24F 13/062 454/312
3,717,081 A * 2/1973 Jakimas ..... F24F 13/06 454/312
6,537,146 B1 * 3/2003 Haynes ..... F24F 13/15 454/290

* cited by examiner

*Primary Examiner* — Steven B McAllister
*Assistant Examiner* — Ko-Wei Lin
(74) *Attorney, Agent, or Firm* — David B. Waller

(57) ABSTRACT

The present invention is a vent cover, kits comprising the vent cover and methods of using the vent cover to direct air flow from a ventilation duct such as those found in homes and businesses. The vent cover has a base, a plurality of concentric segments retractably connected to each other and the base; and a locking element connected to the base and surrounded by the innermost concentric segment. The locking element opens and closes the vent cover. In the open position the plurality of segments are expanded outward from the base allowing air to pass through the vent cover. In the closed position the plurality of concentric segments are retracted flush with the base preventing air from being released from the vent cover.

13 Claims, 2 Drawing Sheets

VENT COVER

CROSS-REFERENCE TO RELATED APPLICATIONS

This application is a non-provisional of 61/802,092 filed Mar. 18, 2013, which is hereby incorporated by reference in its entirety.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention pertains generally to indoor vent covers for heating ventilation and air conditioning systems (HVAC). Also the invention pertains generally to diffusers, louvered vents and screens for ventilation ducts. More particularly, a preferred embodiment provides for covering an indoor vent to prevent drafting while a separate (space) heater is used in an indoor space while also providing versatility to allow air flow when desired.

BACKGROUND OF THE INVENTION

Air duct ventilation covers and diffusers have been known for some time. An early example of a vent cover is provided by J. E. Crute Jr., entitled "Vent Closure," U.S. Pat. No. 2,834,278 being awarded patent protection in 1958. This patent is directed to a weather tight and insulated vent closure for a grill vent opening in a building. A more recent example is provided by T. Mavroudis et al. U.S. Pub. Pat. App. No. 2010/0233953 entitled "Cover for Wall Air Conditioning Vent, now U.S. Pat. No. 8,460,075. This patent is directed to an assembly for covering an air conditioner vent that prevents unwanted upward hot air flow and downward cold air flow in the winter when the air conditioning system is not in use.

As alluded to by Mavroudis and his co-inventor, some homes and other buildings use a central air conditioning system to control the environment during the summer and a separate heating system is used to heat the environment during the winter. A problem arises during the season in which the air conditioning vent is not in use and the heating system is being used (for example space heater or fire place). During that time, the ceiling (or wall) vents for the central air conditioning system are not air tight and energy losses can result. Many devices similar to Mavroudis et al. have been developed that can be affixed to the existing vent cover effectively sealing off the vent and preventing this loss. They are often held in place by Velcro™, magnets or screws. However, this requires removal and replacement of these devices at least once per year as well as requiring storage when they are not in use Conventional vent covers have a lever on the side of the vent that adjusts internal louvers directing air flow in the desired direction. These types of vent covers have several disadvantages. One is that the lever is relatively short making it difficult to reach usually requiring a step stool to enable the user to adjust the air flow. Another is that they are difficult to adjust with anything other than a user's hand. In addition, these levers become difficult to move due to rusting or can become inoperable if paint gets into the mechanism.

Other types of vent covers provide sets of louvers that can be adjusted by hand independently allowing for more control of the flow and direction of the air. However, these types of vents can be cumbersome to use often requiring a ladder or stepping stool to reach the louvers for multiple adjustments throughout the year to assure the desired air flow.

It is with these circumstances in mind that the present invention was conceived. Therefore, it is the object of the present invention to provide a vent cover that in a shut position will completely seal off air into or out from a ventilation duct. It is another object of the present invention to provide a design that is suitable year round or could be easily removed depending on desires of the user. It is further an object of the present invention to incorporate an air freshener to discharge air. Further, is an object of the present invention to provide a design that offers improved directional air flow as may be desired. Additionally still, it is an object of the present invention to provide ease of opening and closure attractive to elderly consumers. It is yet further an object of the present invention to provide a vent cover design that is versatile to fit various sizes and shapes of air vents.

SUMMARY OF THE INVENTION

The present invention is a vent cover, methods of using the vent cover and kits comprising the vent cover. The vent cover is a directional air flow cover for a ventilation duct such as those found in homes and businesses. In one aspect of the present invention the vent cover comprises a base, a plurality of concentric segments retractably connected to each other and the base; and a locking element connected to the base and surrounded by the innermost concentric segment. The locking element opens and closes the vent cover. In the open position the plurality of segments are expanded outward from the base allowing air to pass through the vent cover. In the closed position the plurality of concentric segments are retracted flush with the base preventing air from being released from the vent cover.

In one embodiment of the invention, the locking element is a spring activated push button. When the spring activated push button is compressed the vent is in the closed position and when relaxed the vent is the open position. Alternatively, the locking element may be a series of magnets positioned on the plurality of concentric segments and a pull knob positioned at the center of the innermost concentric segment. When pulled outward away from the base the concentric segments are expanded and the vent opened. When the pull knob is pushed toward the base the concentric segments are retracted allowing the magnets to make contact and closing the vent.

In another embodiment the base and/or the concentric segments further comprise seals that prevent air from escaping from around the concentric segments or the base when the vent is closed.

In yet another embodiment, the plurality of segments further comprise louvers and/or screens perpendicular to and between the plurality of concentric segments. The louvers may be adjustable controlling the amount of air flow through the concentric segments.

In still other embodiments, the vent cover may further comprise a spacer to allow the easy placement over an existing cover or air duct. In addition, a vent cover connected or affixed to a ventilation duct is also provided.

In another aspect, a method of regulating air flow through a ventilation duct is provided comprising the steps of affixing the vent cover of the present invention over a ventilation duct and adjusting the vent cover to regulate the air flow from the duct. In the event that the vent cover of the present invention is placed over an existing cover the method may further comprise opening the existing cover as the initial step. The step of affixing the vent cover over the air duct or existing cover may be achieved by adhesive, magnets or screws. In addition, the vent cover may further comprise a spacer to allow easy placement of the device over the duct or existing cover.

In yet another aspect, a ventilation cover kit is provided comprising the vent cover of the present invention a mounting plate and a bracket. In another embodiment the kit may further comprise a spacer to allow easy placement of the base on the duct or over an existing cover and/or an air freshener cartridge for inserting into a chamber that may be provided in the central concentric segment.

DESCRIPTION OF THE FIGURES

The invention can be better visualized by turning now to the following drawings wherein like elements are referenced by like numerals.

The novel features of this invention, as well as the invention itself, both as to its structure and its operation, will be best understood from the accompanying drawings, taken in conjunction with the accompanying description, in which similar references refer to similar parts.

DETAILED DESCRIPTION

Figure 1:
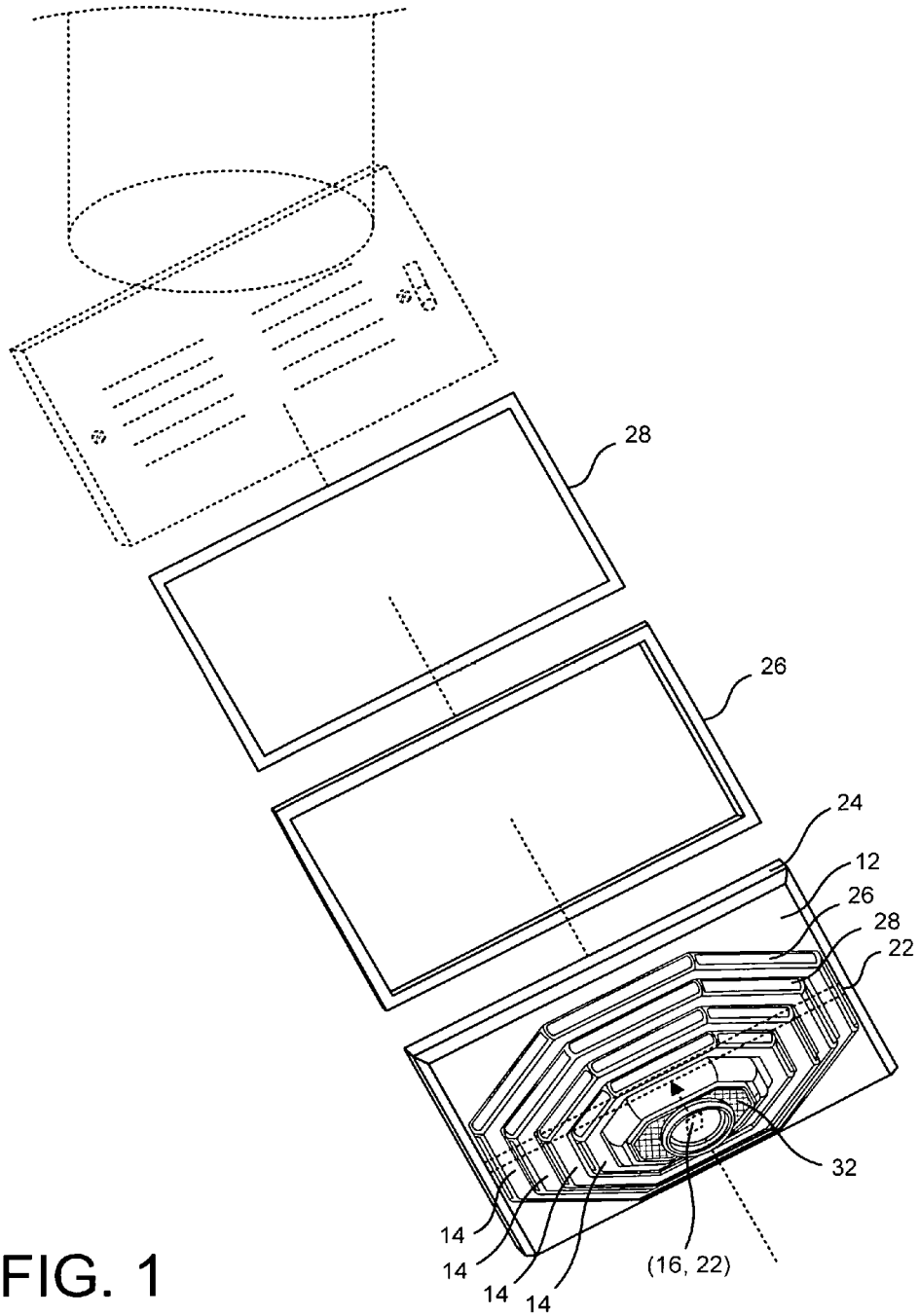
FIG. 1: Is a perspective view of one embodiment of the present invention wherein the vent cover is open.
Figure 2:
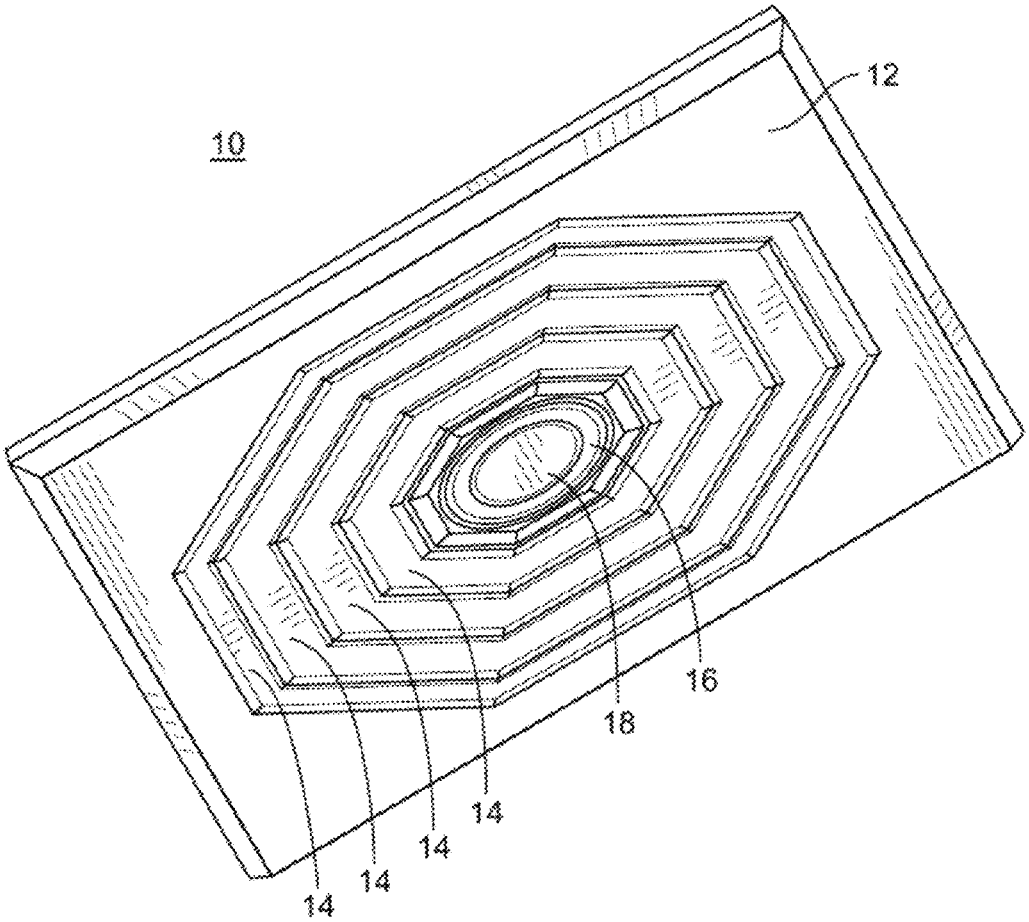
FIG. 2: Is a perspective view of another vent cover of the present invention wherein the vent cover is closed.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "plurality of concentric segments", concentric segments, segments or segment as used herein refers to the portion of the vent cover that permits air to flow from the ventilation duct and directs the air to a desired location in a structure. These segments share the same center and each larger segment completely surrounds the next smaller segment(s). They are interlinked to allow each smaller segment to extend below its adjacent larger segment in an accordion or telescopic configuration allowing air to flow when the vent is in the open position. Correspondingly, when retracted these concentric segments fit one inside the other forming an air tight seal that prevents air flow when the vent is in the closed position.

The term "retractably" as used herein refers to the ability of the plurality of concentric segments to be drawn back together and flush with the vent base forming an air tight seal from an extended or open position that allows air to flow from the vent.

The term "locking element" as used herein refers to a variety of elements or means known to those skilled in the art for securing and releasing the plurality of concentric segments of a vent cover. For example, a locking element may be a static means comprising a series of magnets affixed to the plurality of concentric segments that come into contact when the segments are retracted thereby forming a tight seal that maintains the vent in a closed position restricting or preventing air flow. Correspondingly, the locking element may be dynamic such as a spring loaded push button. When the vent is in the closed position the spring is compressed. Depressing the button releases the tension in the spring which drives the concentric segments into a fully extended position opening the vent. When the button is depressed a second time the spring is depressed retracting the concentric segments closing the vent.

The present invention is a vent cover, methods of using the vent cover to direct air flow from a ventilation duct such as those found in homes and businesses and kits comprising the vent cover. In one aspect of the present invention the vent cover comprises a base, a plurality of concentric segments retractably connected to each other and the base; and a locking element connected to the base and surrounded by the innermost concentric segment. The locking element opens and closes the vent cover. In the open position the plurality of segments are expanded outward from the base allowing air to pass through the vent cover. In the closed position the plurality of concentric segments are retracted flush with the base preventing air from being released from the vent cover.

The invention in another aspect is a vent cover having a plurality of concentric accordion-like segments that rise vertically in an open state and then contract to a relatively flat structure in the closed state. An innermost segment surrounds a push button opener having a spring therein. In a preferred embodiment, the spring is a compression spring relaxed in the open state and latched against spring force in the closed state.

Optionally, a removable spacer is provided depending on needs for proper seal given different geometries of any existing vent. The spacer acts to raise the device in the side aspect. Cover louvers or screens that provide an air tight seal in the closed position (as they are hidden) are configured to sides of said accordion-like segments. Additionally, segments can be octagonal or circular. This configuration provides many options for delivering directional air flow as required by the application or idiosyncrasies of a user.

The device is mountable with magnets in a first embodiment or optionally brackets are used in a second embodiment. The brackets are versatile "C" shaped so that they are reversible to cover different sized discharge air outlets ranging in size from 9"×9", 13.75"λ13.75". A removable shell cover is provided to aesthetic purposes.

1. Base

The base 12 may be provided in a variety of shapes and sizes depending on the shape and size of ventilation duct or existing cover the vent cover 10 of the present invention is intended to cover or replace. For example, the base 12 may be round, square, rectangular or octagonal. In some instances it may be preferable, based on area limitations, to provide a size and shape similar to the existing vent cover. If the vent cover is being replace the exterior dimensions may be identical or slightly larger than the existing vent cover. Alternatively, if the vent cover 10 of the present invention is to cover the existing vent cover, then the size of the base should be slightly larger then the perimeter dimensions of the existing cover. This will allow the vent cover 10 of the present invention to fit flush against the wall or ceiling completely covering the existing vent cover.

In other instances where there may be sufficient room around the ventilation duct or existing vent cover, the base 12 may be larger providing an additional aesthetically appealing look over the previous or existing vent cover. In this regard, the base 12 may be provided in a variety of shapes that may be more attractive than merely functional. For example, the base 12 may have decorative elements that match the existing décor of the room or may have designs that complement or introduce a decorative element into the room.

In some instances, the existing vent cover will remain in place but has a larger profile then conventional covers. In this case, the base 12 may have a deeper or larger profile so that it may completely cover the existing vent cover. For example, conventional vent covers typically have a profile of approximately 0.25 inches. In this case, the depth of the base 12 may be from 0.33 to 0.5, inches. For higher or larger profile vent covers the base 12 will provide from 10% to 25% greater profile depth to adequately cover the existing vent cover.

In another embodiment, the base 12 may be provided with a spacer 26 (not shown in the Figures) that may be added to the base raising the profile of the base 12. The spacer 26 may be a fixed thickness or may be adjustable. A variety of methods may be employed by those skilled in the art to provide an adjustable spacer 26. In one example, the spacer 26 has easily removable sections that allow the user to select the desired height to adequately raise the base and cover the existing vent cover. This spacer 26 may integrate with the edges of the base 12 appearing flush with the sides of the base 12 and increasing the base's profile. Alternatively, the spacer 26 may be decorative appearing as platform on which the base 12 is attached. For example the spacer 26 may look similar to or make the base 12 appear to be rimmed with a decorative molding.

Both the base 12 and the spacer 26 may be provided with a flexible seal 28 about their perimeter edge to assure a relatively air tight seal 28 about the wall, ceiling or ventilation duct. This seal 28 may be made of a variety of materials known to those skilled in the art including for example rubber, neoprene or foam rubber.

The base 12 may be secured in place over the ventilation duct by screws in the same manner as conventional vent covers. Alternatively, if the vent cover 10 is intended to cover an existing vent cover then it may be secured in place by a variety of methods. For example, the base 12 may be equipped with areas having an adhesive or comprise magnetic strips 22 that when placed over the existing vent cover contact its surface and secure the vent cover 10 of the present invention in place. If a spacer 26 is required, the spacer 26 may have the adhesive or magnetic elements. Once the spacer 26 is affixed to the base 12, these elements will then contact the surface of the existing vent cover when the vent cover 10 of the present invention is secured in place.

In some cases, the size and or shape of the existing vent cover that will remain in place may not permit easy attachment of the vent cover 10 of the present invention. In this case, a mounting bracket(s) or mounting plate 24 may be employed that may be attached to the existing vent cover and provide appropriately distanced attachment points for the vent cover 10 of the present invention.

The base 12 and the spacer 26 may be made of a variety of materials known to those skilled in the art. For example, the base 12 and spacer 26 may be made of metal or a polymer. The polymer may be a plastic, high density polymer or temperature resistant polymer. Preferably the base 12 and the spacer 26 are made of the same material.

2. Concentric Segments

The number of concentric segments 14 in the vent cover 10 may vary depending on the size of the duct and desired air flow capacity. For example, the vent cover 10 may comprise from 2 to 30 or more concentric segments 14. These segments 14 are provided in a configuration that allows the segments 14 to be easily interconnected. In addition, these interconnections allow the segments to extend outward from the base 12 exposing openings that provide air flow from the ventilation duct and to retract flush with the base 12 sealing the duct thereby preventing air flow.

The plurality of concentric segments 14 may also be provided in a variety of shapes including for example, round, square, rectangular and octagonal. In addition, the segments 14 shape may be similar to or different from the base 12. For example the concentric segments 14 and the base 12 may be octagonal in shape or the concentric segments may be octagonal and the base 10 square.

The plurality of concentric segments 14 may be provided in a variety of configurations. For example, each concentric segment 14 may have an inner and an outer perimeter edge as well as a top surface that faces the base 12 and a lower surface which faces away from the base 12. On the inner perimeter edge is an ascending skirt oriented about 90° to the upper surface of the concentric segment 14. The ascending skirt has a central body, a bottom edge connected to the inner perimeter edge of the concentric segment and an upper edge. The central body has an inner surface facing the center of the vent cover 10, an outer surface facing away from the center of the vent cover 10 and a plurality of apertures that allow air to flow from the duct when the vent cover 10 is open. The apertures may be provided in a variety of configurations known to those skilled in the art including for example circular, square or rectangular openings positioned side by side along the length of the central body. Alternatively, they may be square or rectangular apertures that span a majority of the length of the central body. In other configurations these apertures may be cover with screen material to prevent particulates from entering through the duct. In another configuration the plurality of apertures are arranged in such a way that they appear to be a grid; not only are the apertures side by side but also above and below. When the apertures are provided in this configuration they may be oriented in a decorative arrangement. For example, circular and square apertures may be intermixed or circular apertures of varying sizes arranged in a circular pattern having larger apertures on the exterior of the pattern with smaller apertures on the interior of the pattern.

In another configuration, the plurality of apertures may include slide adjustable screens 26 or louvers 28. These screens 26 or louvers 28 have one slotted screen component slidably affixed to a second slotted screen component such that sliding one component with respect to the other adjusts the slotted openings thereby regulating the amount of air flowing from the ventilation duct.

The height of the ascending skirt will depend on the desired distance from the base 12 the plurality of concentric segments 14 will extend. For example, if the vent cover 10 is 9 inch by 9 inch and contains four concentric segments 14 and the desired extended distance is 2.5 inches then if the base 12 is about 0.5 inch in depth, the thickness of each concentric segment 14 being about 0.13 inches, there are four openings; one between the base 12 and the first concentric segment 14, and one between each of the remaining segments 14, then the central body of each ascending skirt would be approximately 0.38 inches.

A variety of different types of interconnection means may be used to join the plurality of concentric segments 14 known to those skilled in the art that allow the segments 14 to be extended and retracted in an according-like or telescopic manner. By way of example and not by way of limitation, the connector may be a slide press fit and/or snap clip type. In this configuration, each concentric segment 14 has about four or more connectors that project from the upper edge of the ascending skirt at 90° extending over the top surface of the concentric segment 14. Preferably these connectors are evenly spaced apart along the upper edge of the ascending skirt. If the concentric segments 14 have a shape comprising corners it is preferable that the connectors are positioned near the corners. The ascending skirt has one or more guide rails running the full height of the inner surface of the ascending skirt to receive the connectors from the next smaller concentric segment. Each guide rail has a stop positioned near the bottom edge of the ascending skirt where it is connected to the inner perimeter edge of the concentric segment 14. These connectors are able to be pressed into the guide rail by compressing or depressing the side or sides of the connector allowing it to enter guide rail and immediately snap or spring back into its uncompressed configuration locking one concentric segment 14 to another. The guide rails allow each concentric segment 14 to be securely interconnected and extend and retract easily.

Alternatively, in another configuration, each concentric segment 14 has an inner and an outer perimeter edge as well as a top surface that faces the base 12 and a lower surface which faces away from the base 12. Adjacent to, but not on the inner perimeter edge is an ascending skirt oriented about 90° to the upper surface of the concentric segment 14. The ascending skirt has a central body, a bottom edge connected to the upper surface a set distance from the inner perimeter edge of the concentric segment 14 and an upper edge. The central body has an inner surface facing the center of the vent cover 10, an outer surface facing away from the center of the vent cover 10 and a plurality of apertures that allow air to flow from the duct when the vent cover 10 is open. The placement of the ascending skirt on the upper surface of the concentric segment 14 forms a ledge on the inner surface side of the ascending skirt. On the upper edge of the ascending skirt are adapters, for example, snap clip or screw hole adapters to secure a lip along the upper edge oriented 90° to the ascending skirt and extending over the top surface of the concentric segment 14. This lip provides an interconnecting means to the adjacent larger concentric segment 14 when it interfaces with the ledge of the next smaller concentric segment 14. As stated previously a number of configurations may be provided that allow the segments 14 to be extended and retracted in an according-like or telescopic manner. These are merely two examples of interconnecting means.

In one configuration, the largest concentric segment 14 has two or more identical cylindrical T-shaped knobs evenly spaced about the circumference of the lower surface that are received by keyhole shaped apertures having the same spaced configuration on the base 12. In this embodiment, the plurality of concentric segments 14 may be easily removed and replaced for cleaning or if damaged by merely twisting in a clockwise or counter clockwise direction aligning the round head of the T-shaped knobs with the circular aperture of the keyhole shaped aperture.

In another configuration, one or more of the concentric segments 14 may be angle away from the base 12 to deflect air flow from the ventilation duct away from the surface on which the vent cover 10 is affixed.

The concentric segments 14 may be made of a variety of materials known to those skilled in the art, such as for example, a metal or a polymer. The polymer may be a plastic, high density polymer or temperature resistant polymer. Preferably the concentric segments 14 are made of the same material as the base 12.

3. Locking Element

A number of locking elements 16 known to those skilled in the art may be utilized with the present invention that when activated allow the vent cover 10 to expand into its open position providing air flow from a ventilation duct and retract flush with the base when the vent cover 10 is in the closed position. In one simple example, the plurality of concentric segments 14 have one or more magnetic strips 22 that come in contact when they are retracted securing the vent cover 10 in the closed position. The central concentric segment 14 is provided with a knob that when pulled outward away from the base 12 disengages the magnetic strips 22 opening the vent 10. When the knob is pressed toward the base allow the segments to be extended and retracted in an according-like or telescopic manner. 12 the magnetic strips 22 of the concentric segments 14 come in contact and maintain the vent cover 10 in the closed position.

In another example, a spring loaded button 18 may be used. A variety of this type of locking means known to those skilled in the art may be utilized with the present invention. A preferred spring loaded push button 18 is one that when first depressed releases a compressed spring providing the energy to expand the concentric segments 14 away from the base 12 opening the cover vent 10. When depressed a second time the spring is compressed and the concentric segments 14 are retracted flush with the base 12 locking the cover vent 10 in the closed position. In a preferred embodiment the spring loaded push button 18 is provided about the center of the central concentric segment 14.

4. Air Freshener Chamber

A variety of other elements may be utilized with the present invention. For example, a removable and/or replaceable air freshener insert (not shown in the Figures) may be incorporated into the cover vent 10. This may be achieved in a variety of configurations. In one configuration the central concentric segment 14 further comprises a compartment 32 for retaining an air freshener insert. The compartment 32 provides an enclosure that is openly exposed to the environment allowing air from the ventilation duct to flow over the air freshener and an easily removable cover so that the air freshener insert may be removed or replaced. In one embodiment, the chamber or compartment 32 may be a donut shaped cup that receives a donut shaped air freshener insert having a twist lock adapter on its exterior wall that allows the cup to be easily twisted and locked into place about the locking element 16.

5. Mounting Plate/Bracket

A mounting bracket(s) may be required if the attachment means of the ventilation duct do not align sufficiently with the attachment apertures provided in the vent cover 10 to allow for a secure connection. A mounting bracket may also be desired if the attachment means are to be hidden underneath the base 12. A variety of configurations of mounting brackets may be utilized with the present invention. In one example, the mounting bracket is a plate with a number of apertures that align with several different types of known ventilation duct attachment means as well as a series of apertures that align with the attachment means for the vent cover 10 of the present invention. In one embodiment, these attachment means are screw holes that allow the bracket to be secured by screws to the ventilation duct and the vent cover 10 to be secured to the mounting plate 24 by screws.

In the event that it is desirable to have the attachment means hidden below the base 12 and the mounting plate 24, there are a variety of configurations know to those skilled in the art to accomplish this goal. For example, the mounting bracket may be provided with a number of apertures that align with several different types of known ventilation duct attachment means and snap clip elements along its perimeter edge that interface with corresponding clip retainers provided on the base 12. Once the mounting bracket is anchored on the ventilation duct, the base 12 is then snapped into place securely onto the mounting bracket. In another example, the mounting bracket may be provided with a number of apertures that align with several different types of known ventilation duct attachment means and two or more cylindrical T-shaped knobs evenly spaced about the circumference of the mounting plate 24 that are received by corresponding keyhole shaped apertures having the same spaced configuration provided on the base 12. Once the mounting bracket is anchored on the ventilation duct the keyhole apertures are aligned with the cylindrical T-shaped knobs and twisted securely locking the base 12 onto the mounting bracket. In another embodiment, the cylindrical T-shaped knobs may be provided on the base 12 and the keyhole shaped apertures provided on the mounting bracket.

In another configuration, the mounting brackets are two metallic rectangular elongated strips having an aperture on one end for attachment to the ventilation duct or existing vent cover and a protruding threaded screw on the other for affixing the vent cover 10 of the present invention. Once mounted, one on either side of the ventilation duct or existing vent cover, the elongated strips may be rotated until they align with the apertures of the vent cover 10 of the present invention. The protruding threaded screws are inserted into the apertures of the vent cover 10 and secured in place by a nut. This nut may be a standard hexagonally shaped nut, a wing nut or a decorative nut that does not have the appearance of an affixing means.

Kit

The present invention may be provided in a kit that may comprise a mounting plate 24 and/or mounting brackets, a base 12, a plurality of interconnected concentric segments 14 that may be separate from or connected to the base 12, an air freshener or pack of air fresheners, hardware such as screws and bolts and/or instructions for anchoring the vent cover 10 to the ventilation duct. Because of their unique configuration, the air freshener, that may accompany these kits, may also be sold separately, singly or in packs and in a variety of scents.

These kits may be prepared for the do-it-yourself home repair person or for commercial builders. For the home repair person, a single vent cover 10 may be provided in a kit. For commercial builders, the kit may comprise five, ten or more vent covers 10.

Use

The vent cover of the present invention may be affixed to an existing vent cover or to the ventilation duct directly. If the vent cover is to be placed over and existing vent cover, the existing vent cover should be placed in the full open position. The mounting plate may be affixed to the existing vent cover by unscrewing the screws holding the existing vent cover in place, aligning the apertures of the mounting plate to the existing vent cover apertures and replacing the screws. Once the mounting plate is secured, the base may be screwed, snapped or twisted in position onto the based, securing it over the existing vent cover. If the concentric segments are provided separately from the base they may be affixed to the base by aligning the attachment means and twisting or snapping them into place. When the concentric segments are in place the air freshener, if not already provided within the central concentric segment, may be inserted by removing the donut-shaped cup inserting the air freshener selected and replacing the cup in the central concentric segment.

In another embodiment, the kit is provided with two mounting brackets. If the vent cover is to be placed over and existing vent cover, the existing vent cover should be placed in the full open position. The mounting brackets are affixed to the existing vent cover by unscrewing the screws on either side of the existing vent, aligning the aperture of the mounting bracket to the existing vent cover apertures and replacing the screws. The mounting brackets are swiveled in place until the protruding threaded screws on the opposite ends of the mounting brackets align with the apertures of the base. Nuts are then secured to the protruding threaded screws extending through the apertures of the base securing it over the existing vent cover. The remainder of the vent cover is assembled as described above.

In yet another embodiment, the existing vent cover is removed and replaced with the vent cover of the present invention. In this case, the existing vent cover is removed by unscrewing the attachment screws and removing the cover. If the attachment apertures of the ventilation duct align with the attachment apertures of the base, then the base may be secured in place by replacing the screws. The remainder of the vent cover is assembled as described above. If the attachment means do not align with the ventilation duct attachment means then a mounting plate or mounting brackets may be used as described above. If a mounting plate is selected, the attachment apertures of the ventilation duct are aligned with the apertures provide in the mounting plate and the screws replaced securing the mounting plate to the ventilation duct. The remainder of the vent cover is assembled as described above. If a mounting plate is not desired, mounting brackets may be affixed to the attachment apertures on either side of the ventilation duct. The mounting brackets are swiveled in place until the protruding threaded screws on the opposite ends of the mounting brackets align with the apertures of the base. Nuts are then secured to the protruding threaded screws extending through the apertures of the base securing it to the ventilation duct. The remainder of the vent cover is assembled as described above.

While the particular vent cover as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed mater as viewed by a person with ordinary skill in the art, now known or later devised, are expressly contemplated as being equivalently within the scope of the claims. Therefore, obvious substitutions now of later known to one with ordinary skill in the art are defined to be within the scope of the defined elements.

What is claimed:

1. A vent cover for an air duct comprising:

a. a base;

b. a plurality of concentric segments retractably connected to each other and to said base; and c. a locking element connected to said base and surrounded by the innermost of said plurality of concentric segments, wherein said locking element has an open position when said innermost of said plurality of concentric elements is pulled away from the other concentric elements and a closed position when said innermost of said plurality of concentric elements is pushed toward the other concentric elements and wherein in the closed position said plurality of concentric segments are retracted preventing air from being released from said vent cover and in said open position said plurality of segments are expanded allowing air to pass through said vent cover, wherein said locking element is one or more magnets on said plurality of concentric segments that make contact when said vent cover is in said closed position.

2. The vent cover according to claim 1, wherein said base further comprises a seal that prevents air from escaping from around said base.

3. The vent cover according to claim 1, wherein said plurality of segments further comprise a seal that prevents air from passing between said plurality of segments when said locking element is in said closed position.

4. The vent cover according to claim 1, wherein said plurality of segments further comprise louvers, screens, or both louvers and screens positioned perpendicular to and between said plurality of segments.

5. The vent cover according to claim 4, wherein said louvers are adjustable.

6. The vent cover according to claim 1, further comprising a spacer to be received by said base.

7. A method for regulating air flow through a ventilation duct comprising the steps of:

a. affixing a vent cover over said ventilation duct wherein said vent cover having a base; a plurality of concentric segments retractably connected to each other and to said base; and a locking element connected to said base and surrounded by the innermost of said plurality of concentric segments, wherein said locking element has an open position when said innermost of said plurality of concentric elements is pulled away from the other concentric elements and a closed position when said innermost of said plurality of concentric elements is pushed toward the other concentric elements and wherein in the closed position said plurality of concentric segments are contracted preventing air from being released from said vent cover and in said open position said plurality of segments are expanded allowing air to pass through said vent cover, wherein said locking element one or more magnets on said plurality of concentric segments that make contact when said vent cover is in said closed position and b. adjusting said vent cover to regulate the flow of air from said ventilation duct.

8. The method according to claim 7, wherein said vent cover further comprises a spacer, said method further comprising the step of affixing said spacer to the bottom of said base as the initial step.

9. The method according to claim 7, wherein said affixing is by adhesive, magnet or screw.

10. A ventilation cover kit comprising:

a. a vent cover having a base; a plurality of concentric segments retractably connected to each other and to said base; and a locking element connected to said base and surrounded by the innermost of said plurality of concentric segments, wherein said locking element has an open position when said innermost of said plurality of concentric elements is pulled away from the other concentric elements and a closed position when said innermost of said plurality of concentric elements is pushed toward the other concentric elements and wherein in the closed position said plurality of concentric segments are contracted preventing air from being released from said vent cover and in said open position said plurality of segments are expanded allowing air to pass through said vent cover, wherein said locking element is one or more magnets on said plurality of concentric segments that make contact when said vent cover is in said closed position;

b. a mounting plate to receive said vent cover when a ventilation duct has an existing cover; and c. a bracket to affix to said ventilation duct to receive said mounting plate or said vent cover.

11. The ventilation cover kit according to claim 10, further comprising a spacer to be received by said base.

12. A ventilation duct having a vent cover, said vent cover having a base; a plurality of concentric segments retractably connected to each other and to said base; and a locking element connected to said base and surrounded by the innermost of said plurality of concentric segments, wherein said locking element has an open position when said innermost of said plurality of concentric elements is pulled away from the other concentric elements and a closed position when said innermost of said plurality of concentric elements is pushed toward the other concentric elements and wherein in the closed position said plurality of concentric segments are contracted preventing air from being released from said vent cover and in said open position said plurality of segments are expanded allowing air to pass through said vent cover, wherein said locking element is one or more magnets on said plurality of concentric segments that make contact when said vent cover is in said closed position.

13. The ventilation duct according to claim 12, wherein said vent cover further comprises a spacer.

* * * * *